US008203821B2

(12) United States Patent
Hsieh et al.

(10) Patent No.: US 8,203,821 B2
(45) Date of Patent: Jun. 19, 2012

(54) MULTI-FUNCTION ELECTROSHOCK GUN

(76) Inventors: Ping-Cheng Hsieh, Kaohsiung (TW); Chao-Hsiung Cho, Taipei (TW)

( * ) Notice: Subject to any disclaimer, the term of this patent is extended or adjusted under 35 U.S.C. 154(b) by 65 days.

(21) Appl. No.: 12/801,880

(22) Filed: Jun. 30, 2010

(65) Prior Publication Data

US 2012/0002343 A1 Jan. 5, 2012

(51) Int. Cl.
*F41B 15/04* (2006.01)
*H01T 23/00* (2006.01)

(52) U.S. Cl. ..... 361/232; 361/230

(58) Field of Classification Search ..... 361/232, 361/230

See application file for complete search history.

(56) References Cited

U.S. PATENT DOCUMENTS 7,524,076 B2 * 4/2009 Kukuk ..... 362/112
8,045,316 B2 * 10/2011 Nerheim ..... 361/232
2009/0255434 A1 * 10/2009 Pawloski ..... 102/502

* cited by examiner

*Primary Examiner* — Dharti Patel
(74) *Attorney, Agent, or Firm* — Jacobson Holman PLLC

(57) ABSTRACT

A multi-function electroshock gun includes a gun body that includes a barrel and a grip extending from the barrel, and a firing mechanism mounted in the gun body and operable to propel a projectile that is fired through the barrel. The multi-function electroshock gun further includes an electroshock unit that includes a battery mounted in the gun body, a set of exposed electrodes fixedly mounted to the gun body, and a discharge module. The discharge module is coupled electrically to the battery and the exposed electrodes and is capable of being activated to generate an electrical output signal at the exposed electrodes for administering electric shock by contact. The multi-function electroshock gun also includes a trigger mechanism mounted on the gun body and operable to activate the discharge module.

15 Claims, 3 Drawing Sheets

MULTI-FUNCTION ELECTROSHOCK GUN

BACKGROUND OF THE INVENTION

1. Field of the Invention

The invention relates to a gun, and more particularly to a multi-function electroshock gun.

2. Description of the Related Art

Both a gun and an electric shock stick may be carried by a user, such as a guard or a policeman, for law enforcement or self defense purposes. Although the gun may be used at a projectile range to deter or subdue a target individual, the user may prefer to electrically shock rather than shoot a target individual. However, in the time needed to holster the gun and to ready the electric shock stick, the user may be unable to use either the gun or the electric shock stick while the user is attacked or while the target individual escapes. Accordingly, further improvements may be made.

SUMMARY OF THE INVENTION

The object of the present invention is to provide a multi-function electroshock gun that combines both shooting and electric shock capabilities.

Accordingly, a multi-function electroshock gun of this invention comprises a gun body that includes a barrel and a grip extending from the barrel, and a firing mechanism mounted in the gun body and operable to propel a projectile that is fired through the barrel. The multi-function electroshock gun further includes an electroshock unit that includes a battery mounted in the gun body, a set of exposed electrodes fixedly mounted to the gun body, and a discharge module. The discharge module is coupled electrically to the battery and the exposed electrodes and is capable of being activated to generate an electrical output signal at the exposed electrodes for administering electric shock by contact. The multi-function electroshock gun also includes a trigger mechanism mounted on the gun body and operable to activate the discharge module.

The multi-function electroshock gun of the present invention may therefore be used by security personnel to shoot a target individual at a projectile range or to apply an electric shock to the target individual using electrodes fixed to the gun body of the gun.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
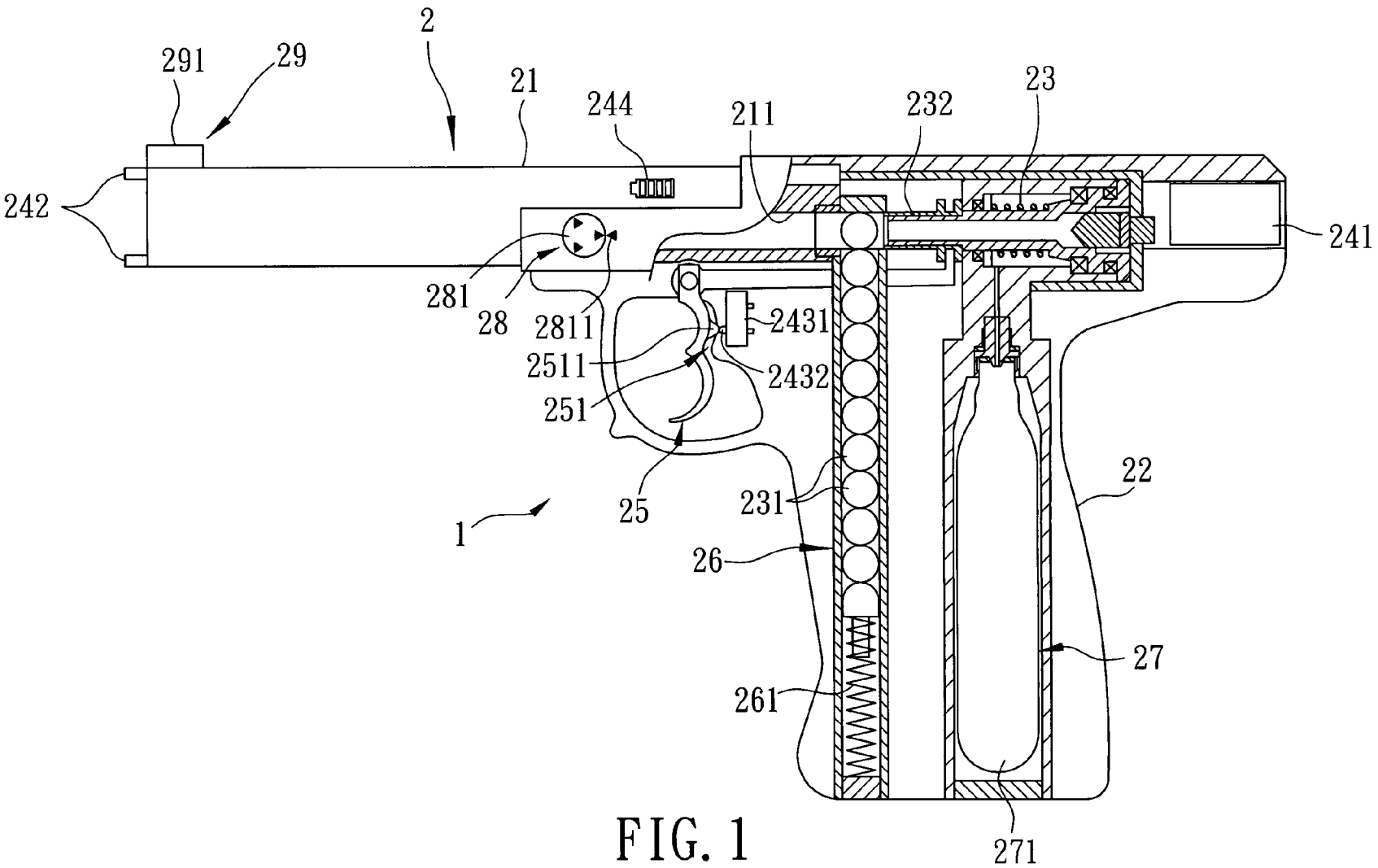
FIG. 1 is a schematic partly sectional view of the first preferred embodiment of a multi-function electroshock gun according to the present invention.

Before the present invention is described in greater detail with reference to the accompanying preferred embodiments, it should be noted herein that like elements are denoted by the same reference numerals throughout the disclosure.

Figure 2:
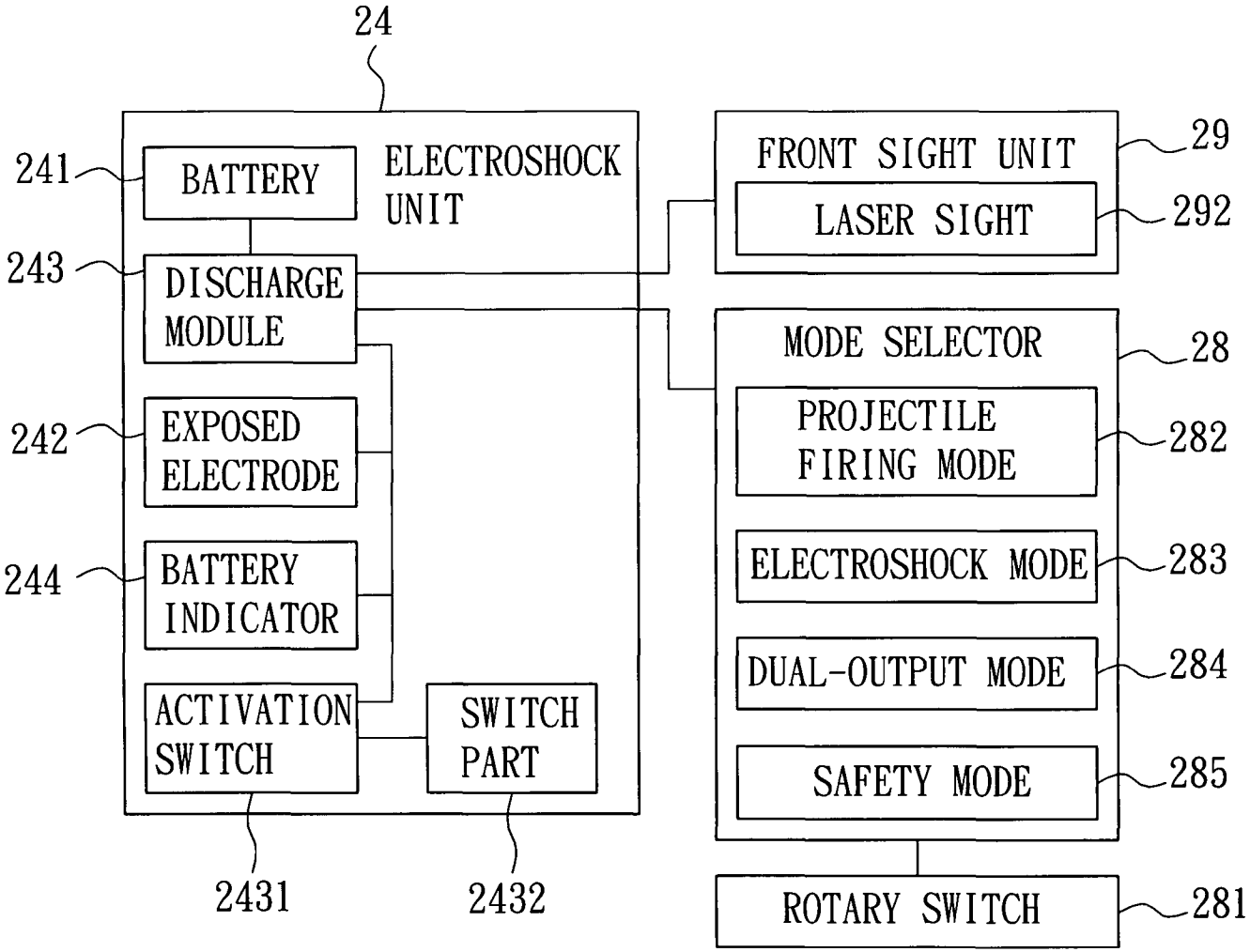
FIG. 2 is a schematic block diagram illustrating components of the first preferred embodiment.

Referring to FIGS. 1 and 2, the first preferred embodiment of a multi-function electroshock gun 1 according to the present invention is shown to include a gun body 2 that has a barrel 21 formed with a barrel bore 211, and a grip 22 extended from the barrel 21. The multi-function electroshock gun 1 further includes a firing mechanism 23 mounted in the gun body 2 and operable to propel a projectile 231 that is fired through the barrel bore 211 of the barrel 21.

In other embodiments, the firing mechanism 23 is operable to ignite a combustible propellant or charge of the projectile 231. The projectile 231 may be a bullet, a pellet or another type of projectile 231, and it may be formed from metal, rubber or plastic, among other materials suitable for projectiles 231. The projectile 231 is not limited to what is disclosed herein.

The multi-function electroshock gun 1 includes a magazine 26 that stores a plurality of projectiles 231. The magazine 26 is removably inserted in the grip 22 and is operatively associated with the firing mechanism 23. The magazine 26 includes a biasing member 261 for biasing the projectiles 231 upward toward the barrel 21.

The multi-function electroshock gun 1 further includes a power source 27 that is mounted to the gun body 2 and provides propelling energy to the firing mechanism 23 for firing the projectile 231. The power source 27 may include a compressed gas cylinder 271, such as a CO2 cartridge. The firing mechanism 23 includes a hammer 232 driven by the energy provided by the power source 27 to propel the projectile 231 through the barrel 21. In other embodiments, the projectile 231 may be driven by gas rather than the by hammer 232, and the power source 27 for the projectile 231 may be a propellant that is combustible. For example, the propellant may include a gunpowder, such as black powder or smokeless powder, and it may be stored with the projectile 231 rather than being mounted to the gun body 2.

The multi-function electroshock gun 1 also includes an electroshock unit 24 that has a battery 241, a pair of exposed electrodes 242 mounted fixedly to the gun body 2, and a discharge module 243 that is electrically coupled to the exposed electrodes 242 and the battery 241. The exposed electrodes 242 are disposed at a front end of the barrel 21, but they may be disposed at any other suitable part of the gun body 2 in other embodiments. The discharge module 243 is capable of being activated to generate an electrical output signal at the exposed electrodes 242 for administering electric shock through contact. The discharge module 243 includes an activation switch 2431 that may be operated to activate the discharge module 243. The activation switch 2431 includes a switch part 2432 that may be moved to operate the activation switch 2431. In other embodiments, the switch part 2432 may be fixed in place and may include an electrical contact. The electroshock unit 24 also includes a battery indicator 244 coupled electrically to the battery 241. The battery indicator 244 may be used to indicate the residual electric power of the battery 241 to show whether the battery 241 should be replaced. The battery indicator 244 is mounted on the barrel 21 of the gun body 2 in this embodiment.

The multi-function electroshock gun 1 further includes a trigger mechanism 25 disposed at the junction between the barrel 21 and the grip 22. The trigger mechanism 25 is operatively associated with the power source 27, and is operable to control the supply of the propelling energy to the firing mechanism 23. In addition, the trigger mechanism 25 includes a switch actuator 251 that has a projecting part 2511 oriented towards the grip 22. The projecting part 2511 may abut against and actuate the switch part 2432 of the activation switch 2431 of the discharge module 243 to activate the discharge module 243 when the trigger mechanism 25 is operated. In other embodiments, the trigger mechanism 25 may be mounted to any part of the gun body 2, and it may be operated to initiate combustion of the propellant to fire the projectile 231 through the barrel 21.

The multi-function electroshock gun 1 further includes a mode selector 28 that may be electrically coupled to the discharge module 243 and electrically or mechanically coupled to the power source 27. The mode selector 28 includes a rotary switch 281 that is mounted rotatably on the gun body 2. The rotary switch 281 is disposed at a lateral side of the barrel 21 above the trigger mechanism 25 in this embodiment. The rotary switch 281 includes a selection indicator 2811 mounted to the gun body 2 to enable alignment of the rotary switch 281. In other embodiments, the mode selector 28 may be electrically or mechanically coupled to the firing mechanism 23 rather than the power source 27, and the selection indicator 2811 may be mounted to the rotary switch 281.

The mode selector 28 is operable in a selected one of a projectile firing mode 282, an electroshock mode 283, a dual-output mode 284, and a safety mode 285. In the projectile firing mode 282, the discharge module 243 is disabled and the power source 27 is enabled. In the electroshock mode 283, the discharge module 243 is enabled and the power source 27 is disabled. In the dual-output mode 284, both the discharge module 243 and the power source 27 are enabled. In the safety mode 285, both the discharge module 243 and the power source 27 are disabled. In other embodiments, the firing mechanism 23 instead of the power source 27 may be enabled or disabled by the mode selector 28, either mechanically or electrically.

The multi-function electroshock gun 1 also includes a front sight unit 29 mounted fixedly to a top edge of the front end of the barrel 21. In the preferred embodiment, the front sight unit 29 includes either a fixed sight 291 or a laser sight 292 that is coupled to the battery 241 and mounted at a front end of the barrel 21.

Figure 3:
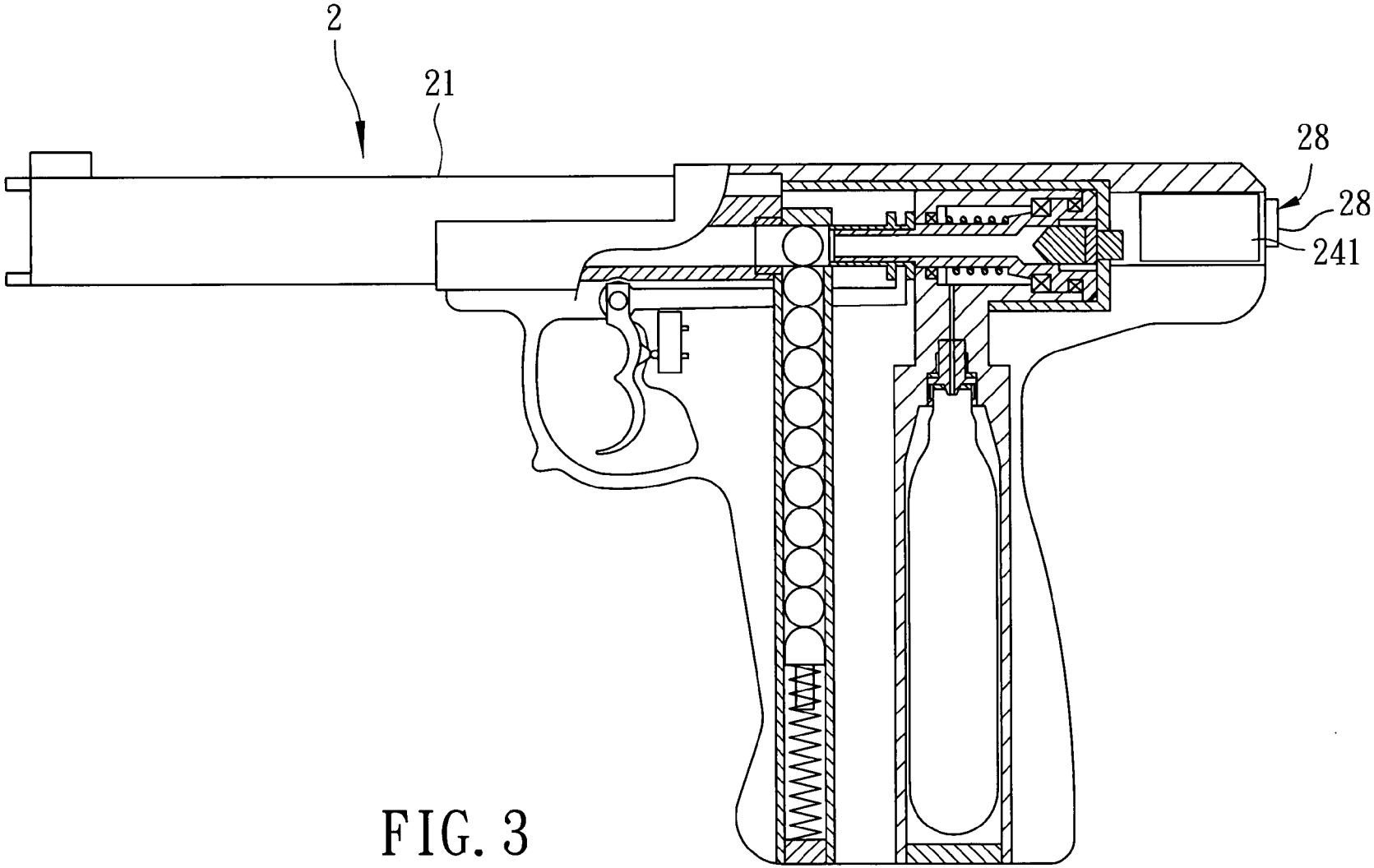
FIG. 3 is a schematic partly sectional view of the second preferred embodiment.

Referring to FIG. 3, the second preferred embodiment of this invention is generally similar to the first preferred embodiment, but differs in that the rotary switch 281 of the mode selector 28 is mounted rotatably to a rear end of the barrel 21. However, the rotary switch 281 of the second embodiment remains operable to select the operational mode of the multi-function electroshock gun 1.

A user of the multi-function electroshock gun 1 according to a preferred embodiment may be a security guard, a policeman, or a member of any other profession. The user may be attacked or be in conflict with a target individual who may be a mugger, a robber, or an individual who is hostile to the user.

When the multi-function electroshock gun 1 is not in use, the mode selector 28 may be switched to the safety mode 285 to prevent unintended injury. In the safety mode 285, the projectile 231 will not be fired and the discharge module 243 will not be activated due to accidental operation of the trigger mechanism 25.

If the user encounters the target individual, the mode selector 28 may be switched to the projectile firing mode 282. The user may aim the multi-function electroshock gun 1 using the front sight unit 29. The user may then operate the trigger mechanism 25 to fire the projectile 231 by releasing gas from the gas cylinder 271, driving the hammer 232 to strike the projectile 231 and propelling the projectile 231 through the barrel 21. The front sight unit 29 includes the laser sight 292, which may assist with aiming the multi-function electroshock gun 1 and may have a deterrent effect on the target individual. In the projectile firing mode 282, actuating the trigger mechanism 25 only fires the projectile 231.

If the target individual and the user are sufficiently close to each other, the user may change the operation of the mode selector 28 from the projectile firing mode 282 to the electroshock mode 283. In the electroshock mode 283, the discharge module 243 is activated while the user operates the trigger mechanism 25 and the projecting part 2511 abuts against the switch part 2432 of the activation switch 2431 of the electroshock unit 24. In other embodiments, the switch part 2432 is fixed in place and includes an electrical contact, and the discharge module 243 is activated while the projecting part 2511 abuts against the electrical contact of the switch part 2432.

While activated, the discharge module 243 generates an output signal at the exposed electrodes 242 that are fixedly mounted to the front end of the barrel 21 for administering electric shock by contact. The user may then contact the target individual with the exposed electrodes 242 to administer electric shock and to stun the target individual.

In addition, the user may change the operation of the mode selector 28 to the dual-output mode 284 so that both the projectile firing function and the electric shock function are enabled. In the dual-output mode 284, when the trigger mechanism 25 is actuated, a projectile 231 is fired and the electrical output signal is generated at the exposed electrodes 242. In other embodiments; the trigger mechanism 25 may have a first angle at which the projectile 231 is fired, and a second angle at which the projecting part 2511 abuts against the switch part 2432 of the activation switch 2431 to activate the discharge module 243. In other embodiments, the discharge module 243 may be activated when the switch part 2432 is moved, or when electrical contact occurs between the projecting part 2511 and the switch part 2432.

The placement and form of the gas cylinder 271, the battery 241, the battery indicator 244 and the hammer 232 may be varied in other embodiments, and should not be limited to the disclosed embodiments. In addition, the preferred embodiment of a multi-function electroshock gun 1 fires a projectile 231 using pressurized gas. In other embodiments, however, the multi-function electroshock gun 1 may be implemented using any type of gun or firearm, such as a pistol, a shotgun, a rifle, a machine gun, etc., and should therefore not be limited to what is disclosed herein.

Given that the multi-function electroshock gun 1 may be switched between projectile firing and electric shock functions, the present invention may reduce the time and effort associated with carrying and using two different types of devices.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A multi-function electroshock gun comprising:

a gun body including a barrel and a grip extending from said barrel;

a firing mechanism mounted in said gun body and operable to propel a projectile that is fired through said barrel;

an electroshock unit including a battery mounted in said gun body, a set of exposed electrodes fixedly mounted to said gun body, and a discharge module coupled electrically to said battery and said exposed electrodes and capable of being activated to generate an electrical output signal at said exposed electrodes for administering electric shock by contact;

a trigger mechanism mounted on said gun body and operable to activate said discharge module;

a power source mounted to said gun body and providing propelling energy to said firing mechanism for firing the projectile, wherein said trigger mechanism is further associated operatively with said power source and is operable to control supply of the propelling energy to said firing mechanism; and a mode selector coupled to said discharge module and said power source, said mode selector being operable in a selected one of a projectile firing mode, where said discharge module is disabled and said power source is enabled, an electroshock mode, where said discharge module is enabled and said power source is disabled, a dual-output mode, where both of said discharge module and said power source are enabled, and a safety mode, where both of said discharge module and said power source are disabled.

2. The multi-function electroshock gun as claimed in claim 1, further comprising a magazine that stores a plurality of the projectiles, that is removably inserted in said grip, and that is operatively associated with said firing mechanism.

3. The multi-function electroshock gun as claimed in claim 2, wherein said magazine includes a biasing member for biasing the projectiles toward said barrel.

4. The multi-function electroshock gun as claimed in claim 2, wherein the projectiles are formed from one of plastic and rubber.

5. The multi-function electroshock gun as claimed in claim 1, wherein said power source includes a compressed gas cylinder.

6. The multi-function electroshock gun as claimed in claim 1, wherein said firing mechanism includes a hammer driven by the energy provided by said power source to propel the projectile through said barrel.

7. The multi-function electroshock gun as claimed in claim 1, wherein said mode selector includes a rotary switch mounted rotatably on said gun body.

8. The multi-function electroshock gun as claimed in claim 7, wherein said rotary switch is disposed at a rear end of said barrel.

9. The multi-function electroshock gun as claimed in claim 1, wherein said exposed electrodes are disposed at a front end of said barrel.

10. The multi-function electroshock gun as claimed in claim 1, wherein said electroshock unit further includes a battery indicator mounted on said gun body and coupled electrically to said battery for indicating residual electric power of said battery.

11. The multi-function electroshock gun as claimed in claim 1, wherein said gun body further includes a sighting unit having a laser sight that is mounted on said barrel and coupled to said battery.

12. The multi-function electroshock gun as claimed in claim 1, wherein said firing mechanism is operable to ignite a combustible charge to fire the projectile through said barrel.

13. A multi-function electroshock gun comprising:

a gun body including a barrel and a grip extending from said barrel;

a firing mechanism mounted in said gun body and operable to propel a projectile that is fired through said barrel;

an electroshock unit including a battery mounted in said gun body, a set of exposed electrodes fixedly mounted to said gun body, and a discharge module coupled electrically to said battery and said exposed electrodes and capable of being activated to generate an electrical output signal at said exposed electrodes for administering electric shock by contact;

a trigger mechanism mounted on said gun body and operable to activate said discharge module;

a power source mounted to said gun body and providing propelling energy to said firing mechanism for firing the projectile; and a mode selector coupled to said discharge module and said power source, said mode selector being operable in a selected one of a projectile firing mode, where said discharge module is disabled and said power source is enabled, an electroshock mode, where said discharge module is enabled and said power source is disabled, a dual-output mode, where both of said discharge module and said power source are enabled, and a safety mode, where both of said discharge module and said power source are disabled.

14. A multi-function electroshock gun comprising:

a gun body including a barrel and a grip extending from said barrel;

a firing mechanism mounted in said gun body and operable to propel a projectile that is fired through said barrel;

an electroshock unit including a battery mounted in said gun body, a set of exposed electrodes fixedly mounted to said gun body, and a discharge module coupled electrically to said battery and said exposed electrodes and capable of being activated to generate an electrical output signal at said exposed electrodes for administering electric shock by contact; and a trigger mechanism mounted on said gun body and operable to activate said discharge module;

wherein said discharge module includes an activation switch, and said trigger mechanism includes a switch actuator, said switch actuator actuating said activation switch to activate said discharge module when said trigger mechanism is operated.

15. The multi-function electroshock gun as claimed in claim 14, wherein said activation switch includes a movable switch part, and said switch actuator includes a projecting part for abutting against said movable switch part.

* * * * *